US006790796B2

(12) United States Patent
Smith et al.

(10) Patent No.: US 6,790,796 B2
(45) Date of Patent: Sep. 14, 2004

(54) NONWOVENS FORMING OR CONVEYING FABRICS WITH ENHANCED SURFACE ROUGHNESS AND TEXTURE

(75) Inventors: Scott Sheldon Smith, Appleton, WI (US); Paul Allen Zimmerman, Portland, TN (US); Mark Joseph Levine, Hendersonville, TN (US)

(73) Assignee: Albany International Corp., Albany, NY (US)

( * ) Notice: Subject to any disclaimer, the term of this patent is extended or adjusted under 35 U.S.C. 154(b) by 121 days.

(21) Appl. No.: 09/972,328

(22) Filed: Oct. 5, 2001

(65) Prior Publication Data

US 2003/0068948 A1 Apr. 10, 2003

(51) Int. Cl.[7] ..... D03D 15/00

(52) U.S. Cl. ..... 442/189; 442/187; 442/192; 442/195; 442/229; 442/301; 28/104; 28/105

(58) Field of Search ..... 28/100, 103, 104, 28/105; 442/187, 189, 192, 195, 229, 301, 196, 288; 162/348, 358.1, 358.3, 900, 902, 903; 428/400

(56) References Cited

U.S. PATENT DOCUMENTS

| | | | | |
|---|---|---|---|---|
| 2,983,986 A | | 5/1961 | Helland | |
| 3,030,690 A | | 4/1962 | Mizell | |
| 3,158,984 A | | 12/1964 | Butler | |
| 4,105,495 A | | 8/1978 | Pai | |
| 4,186,780 A | | 2/1980 | Josef et al. | |
| 4,518,644 A | | 5/1985 | Vuorio | |
| 4,533,594 A | | 8/1985 | Buchanan | |
| 4,557,968 A | * | 12/1985 | Thornton et al. | 442/198 |
| 4,569,883 A | | 2/1986 | Renjilian | |
| 4,746,546 A | | 5/1988 | Bachmann et al. | |
| 4,799,998 A | | 1/1989 | Dutt | |
| 4,943,476 A | | 7/1990 | Sokaris | |
| 4,948,658 A | | 8/1990 | Hälker | |
| 4,981,745 A | | 1/1991 | Lefkowitz | |
| 5,066,532 A | | 11/1991 | Gaisser | |
| 5,077,116 A | | 12/1991 | Lefkowitz | |
| 5,429,686 A | | 7/1995 | Chiu et al. | |
| 5,437,315 A | | 8/1995 | Ward | |
| 5,456,293 A | | 10/1995 | Ostermayer et al. | |
| 5,466,514 A | | 11/1995 | Kataoka et al. | |
| 5,566,724 A | | 10/1996 | Trokhan et al. | |
| 5,628,876 A | | 5/1997 | Ayers et al. | |
| 5,985,450 A | | 11/1999 | Keller | |
| 6,352,772 B1 | * | 3/2002 | Keller | 428/364 |
| 6,500,776 B2 | * | 12/2002 | Hamada et al. | 442/192 |
| 6,509,285 B1 | * | 1/2003 | Yeh | 442/195 |
| 2003/0054719 A1 | * | 3/2003 | Takagi et al. | 442/190 |
| 2003/0171050 A1 | * | 9/2003 | Eichhorn et al. | 442/301 |

FOREIGN PATENT DOCUMENTS

| | | | | |
|---|---|---|---|---|
| EP | 0 511 025 A | | 10/1992 | |
| EP | 0 747 528 A | | 12/1996 | |
| JP | 55145616 | | 10/1980 | |
| JP | 08219868 | | 8/1996 | |
| JP | 11222726 A | * | 8/1999 | D01F/8/14 |

OTHER PUBLICATIONS

International Search Report issued by European Patent Office for corresponding international application PCT/US02/31101, mailed Feb. 26, 2003.

* cited by examiner

*Primary Examiner*—Cheryl A. Juska
(74) *Attorney, Agent, or Firm*—Frommer Lawrence & Haug LLP; Ronald R. Santucci

(57) ABSTRACT

An industrial fabric used in the form of an endless fabric belt to form and convey a nonwoven fiber web during the manufacture of a nonwoven fabric has a web-supporting surface which includes rough-surface yarns which inhibit movement, namely, slippage, of the nonwoven fiber web relative to the web-supporting surface. Preferably, the rough-surface yarns make long floats in one or both directions, that is, lengthwise and/or crosswise, on the web-supporting surface.

28 Claims, 4 Drawing Sheets

NONWOVENS FORMING OR CONVEYING FABRICS WITH ENHANCED SURFACE ROUGHNESS AND TEXTURE

BACKGROUND OF THE INVENTION

1. Field of the Invention

The present invention relates to the manufacture of nonwoven fabrics. More specifically, it relates to endless fabric belts on which nonwoven fabrics are formed and/or conveyed during their manufacture.

2. Description of the Prior Art

The production of nonwoven fabrics is well known in the art. Such fabrics are produced directly from fibers without conventional spinning, weaving or knitting operations. Instead, they may be produced by spin-bonding or melt-blowing processes in which newly extruded fibers are laid down to form a web while still in a hot, tacky condition following extrusion, whereby they adhere to one another to yield an integral web.

Nonwoven fabrics may also be produced by air-laying or carding operations where the web of fibers is consolidated, subsequent to deposition, into a nonwoven fabric by needling or hydroentanglement. In the latter, high-pressure water jets are directed vertically down onto the web to entangle the fibers with each other. In needling, the entanglement is achieved mechanically through the use of a reciprocating bed of barbed needles which force fibers on the surface of the web further thereinto during the entry stroke of the needles.

Endless fabric belts play a key role in these processes. Generally, these take the form of fine-mesh screens woven from plastic monofilament, although metal wire may be used instead of plastic monofilament when temperature conditions during a nonwovens manufacturing process make it impractical or impossible to use plastic monofilament.

Typically, the plastic monofilaments and metal wires have smooth surfaces. As a consequence, the surfaces of the endless fabric belts used in the nonwovens manufacturing process are also smooth. While such surfaces are highly desirable for most paper machine clothing, in nonwovens manufacture such a surface can render forming and conveying operations unstable because slippage or movement by the nonwoven fabric being manufactured, relative to the endless fabric belt, in either the machine direction, the cross-machine direction, or in both of these directions, can occur.

The present invention provides a solution to this problem in the form of an endless fabric belt having a degree of surface roughness or texture to inhibit movement or slippage of a nonwoven fabric relative thereto.

SUMMARY OF THE INVENTION

Accordingly, the present invention is an improvement for an industrial fabric of the variety used in the form of an endless fabric belt to form and convey a nonwoven fiber web during the manufacture of a nonwoven fabric therefrom. The industrial fabric is woven from warp and weft yarns, and has a web-supporting surface.

The improvement is that at least some of one of the warp and weft yarns on the web-supporting surface of the industrial fabric are rough-surface yarns, which inhibit the movement of a nonwoven fiber web being conveyed on the web-supporting surface from moving relative thereto. The rough-surface yarns may be in one or both directions on the web-supporting surface of the industrial fabric, and may be some or all of the yarns in that direction or in both directions. Preferably, at least some of the rough-surface yarns make long floats on the web-supporting surface of the industrial belt.

The rough-surface yarns may be striated monofilaments or multistrand yarns, the latter being a plurality of filaments either twisted about one another or braided together. The rough surfaces of these yarns, as opposed to the smooth surfaces of the monofilament yarns customarily used in industrial fabrics of the present variety, provide the industrial fabrics with a unique surface roughness or texture which enables them to convey a nonwoven fiber web without slippage, while having minimal impact on such desirable characteristics as air permeability and web release.

The present invention will now be described in more complete detail with frequent reference being made to the drawings identified below.

DETAILED DESCRIPTION OF THE PREFERRED EMBODIMENTS

Figure 1:
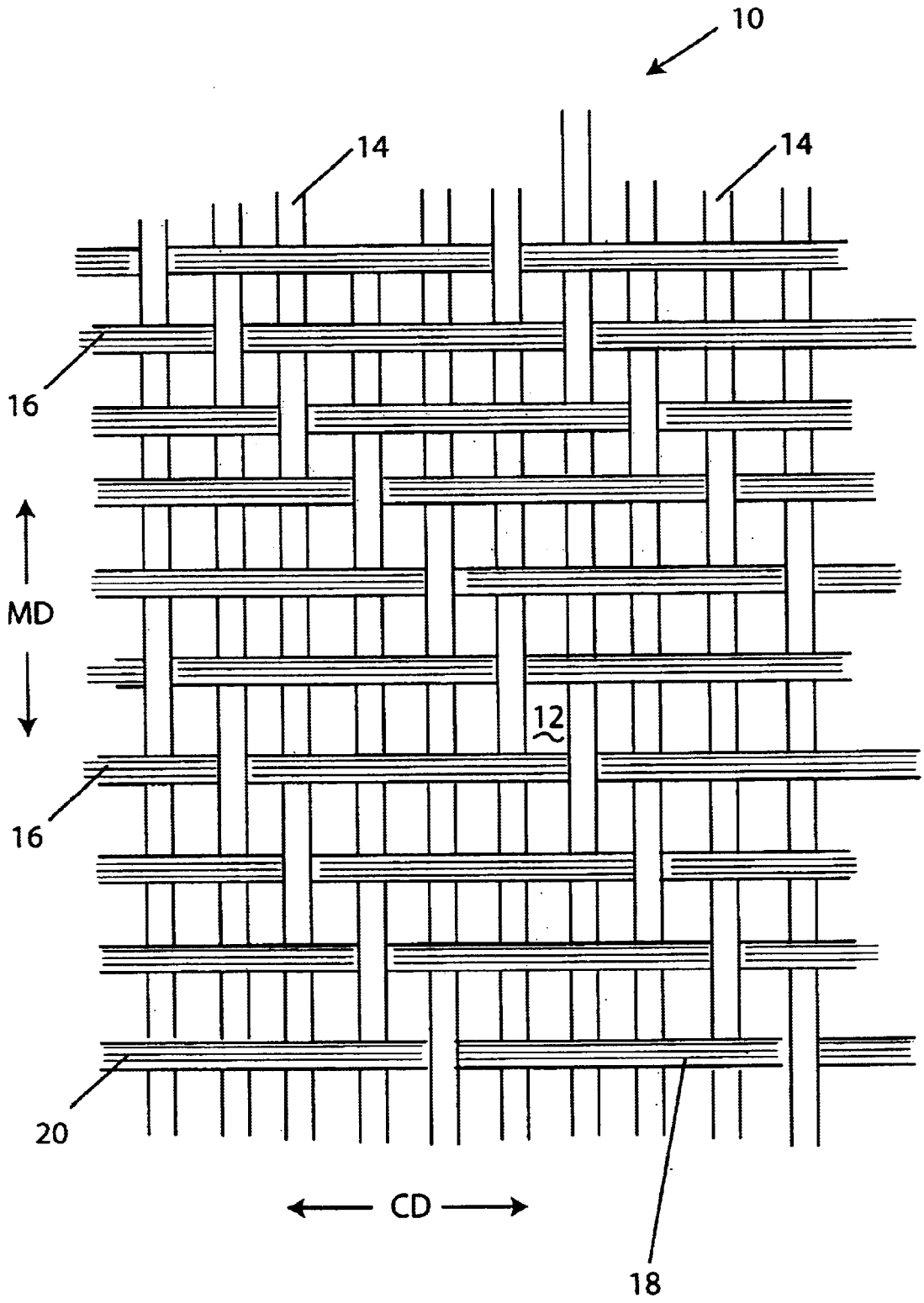
FIG. 1 is a plan view of the web-supporting surface of an industrial fabric improved in accordance with the present invention.

Referring now specifically to these figures, FIG. 1 is a plan view of the web-supporting surface 12 of the industrial fabric 10 of the present invention. As depicted there, industrial fabric 10 is a single-layer fabric woven from warp yarns 14 and weft yarns 16 in 5-shed satin weave which yields long floats in the weftwise direction as the weft yarns 16 pass over four consecutive warp yarns 14 and under one warp yarn 14 in each repeat of the weave pattern. On the web-supporting surface 12, weft floats 18 predominate on and make up most of the area of the surface 12.

Weft yarns 16 are striated yarns, as indicated by the fine lines 20 running lengthwise therealong in FIG. 1. The meaning of the term "striated yarn" will be discussed more completely below, but it will suffice to state here that weft yarns 16, being striated yarns, have a rough surface which reduces the possibility of slippage by a nonwoven fiber web being conveyed by the fabric 10 relative thereto. More specifically, as indicated in FIG. 1, warp yarns 14 are oriented in the machine direction of the apparatus on which the industrial fabric 10 is used in the form of an endless belt after being flat woven and joined into endless form with a seam. Weft yarns 16 are oriented in the cross-machine direction of that machine, and, because of their rough surfaces, inhibit slippage by a nonwoven fiber web being conveyed thereon in the machine, or running, direction of the fabric 10.

It will be clear to those of ordinary skill in the art that fabric 10 could alternatively be woven in a 5-shed satin weave which yields long floats in the warpwise direction. In such a situation, the warp yarns 14, which would be striated yarns, would pass over four consecutive weft yarns 16 and under one weft yarn 16 in each repeat of the weave pattern. In contrast to fabric 10 as depicted in FIG. 1, warp floats would predominate on and make up most of the area of the web-supporting surface 12 thereof. As a consequence, the warp yarns 14, being striated yarns and being oriented in the machine direction, would inhibit slippage by a nonwoven fiber web being conveyed thereon in the cross-machine, or transverse, direction of the fabric 10.

Figure 2:
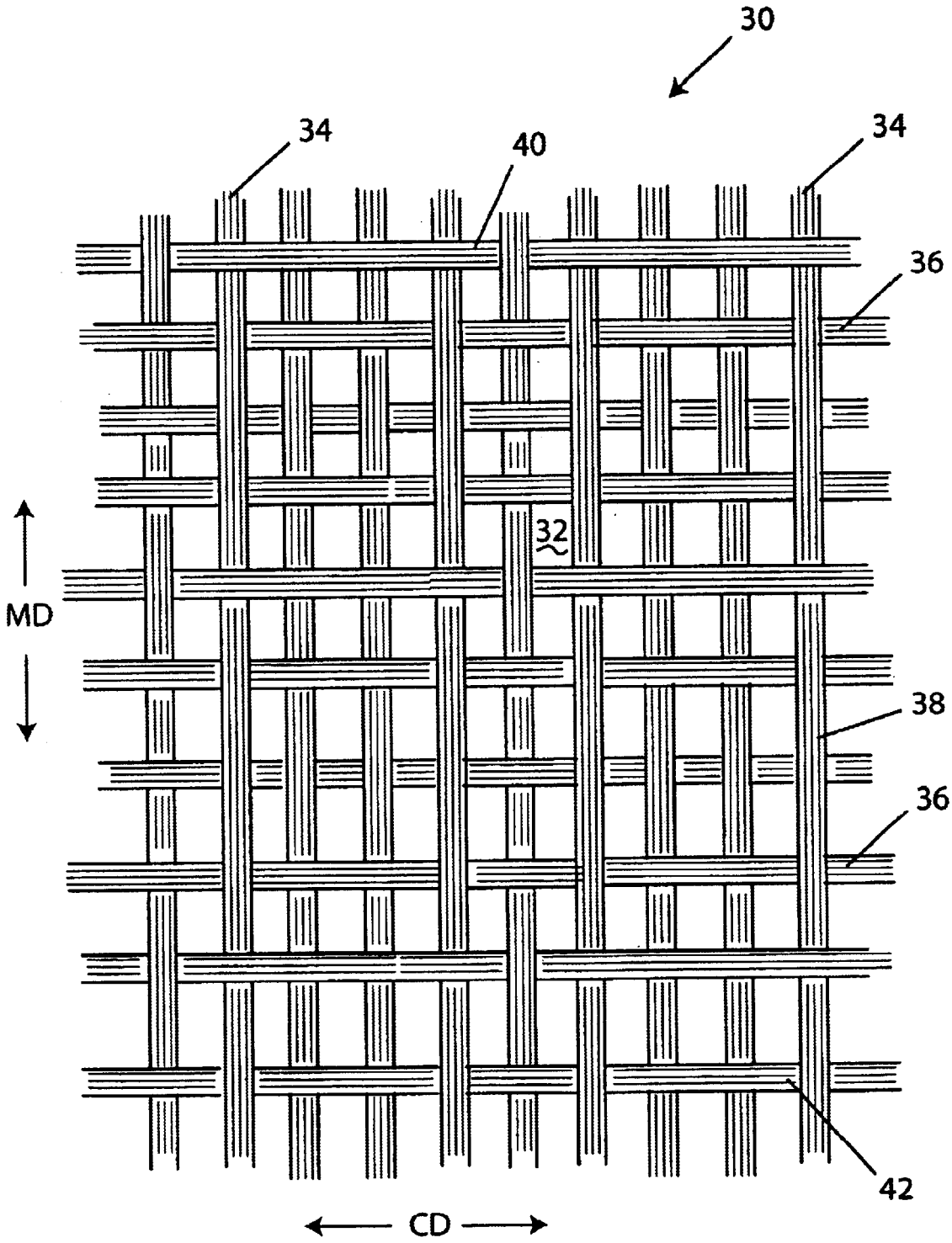
FIG. 2 is a plan view of an alternate embodiment of the improvement.

In another embodiment of the present invention, as shown in FIG. 2, a plan view of the web-supporting surface 32 of another industrial fabric 30, fabric 30 is also a single-layer fabric woven from warp yarns 34 and weft yarns 36 in a weave pattern which yields long floats in both the warpwise and weftwise directions. In the particular weave shown, warp floats 38 are formed where warp yarns 34 pass over two or more consecutive weft yarns 36, and weft floats 40 are formed where weft yarns 36 pass over two or more consecutive warp yarns 34.

Both warp yarns 34 and weft yarns 36 are striated yarns, as indicated by fine lines 42 running lengthwise therealong in FIG. 2, which have a rough surface to reduce the possibility of slippage by a nonwoven fiber web being conveyed by the fabric 30 relative thereto. As indicated in FIG. 2, the warp yarns 34 are oriented in the machine direction, and weft yarns 36 are oriented in the cross-machine direction, of the apparatus on which the industrial fabric 30 is used in the form of an endless belt after being flat woven and joined into endless form with a seam. Both warp yarns 34 and weft yarns 36, or, more specifically, both warp floats 38 and weft floats 40, inhibit slippage by a nonwoven fiber web being conveyed on web-supporting surface 32, the warp floats 38 inhibiting slippage in the cross-machine direction, and the weft floats 40 doing so in the machine direction.

While FIGS. 1 and 2 show specific single-layer weaves for the industrial fabrics improved by the present invention, it should be understood that the present invention is not limited to fabrics having the illustrated weave patterns. In other words, the industrial fabrics of the present invention may be woven in any of the single-, double- and triple-layer weave patterns known to and used by those of ordinary skill in the industrial-fabric art. In all possible embodiments, however, the striated yarns, or alternatives thereto as will be discussed below, weave to the web-supporting surface of the industrial fabric, preferably doing so as long floats in either the machine direction, the cross-machine direction, or in both of these directions.

Figure 3:
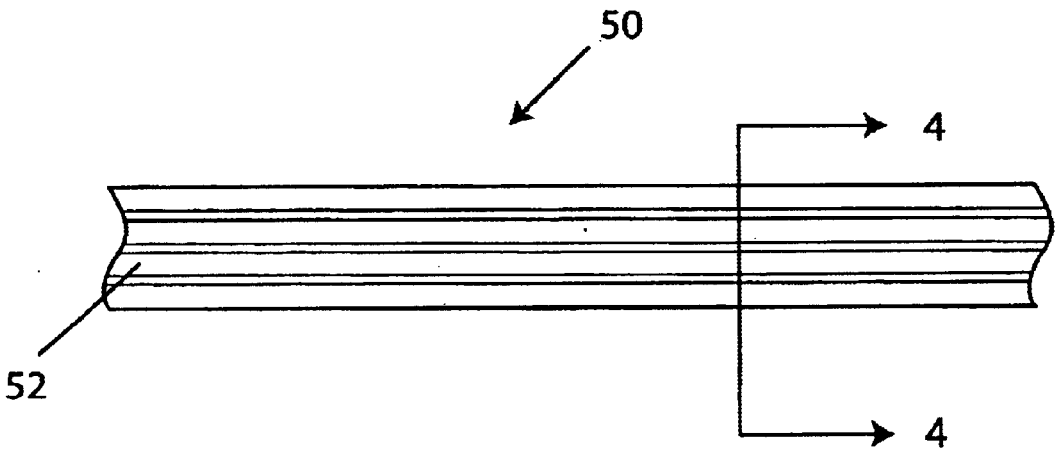
FIG. 3 is a plan view of a striated monofilament yarn.
Figure 4:
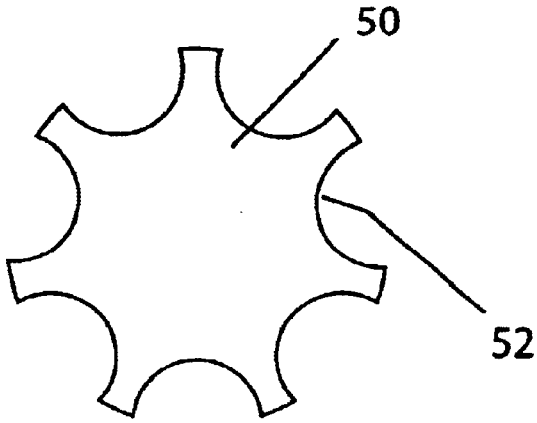
FIG. 4 is a cross-sectional view taken as indicated by line 4—4 in FIG. 3.

Turning now to the striated yarns themselves, the preferred form of the striated yarns is shown in FIGS. 3 and 4. In the first of these figures, a plan view of a striated monofilament yarn 50, parallel grooves or channels 52 run lengthwise along the surface of the monofilament yarn 50. The channels 52, as shown in the cross-sectional view presented in FIG. 4, which is taken as indicated by line 4—4 in FIG. 3, are of semicircular cross-sectional shape, although the shape of the channels 52 may be of any other shape without departing from the scope of the present invention. Preferably, the depth of the channels 52 is from 5% to 25% of the diameter of the monofilament yarn 50.

The monofilament yarn 50 may have the circular cross section shown in FIG. 4, but may alternatively be of oval, or elliptical, square or rectangular cross-sectional shape.

Figure 5:
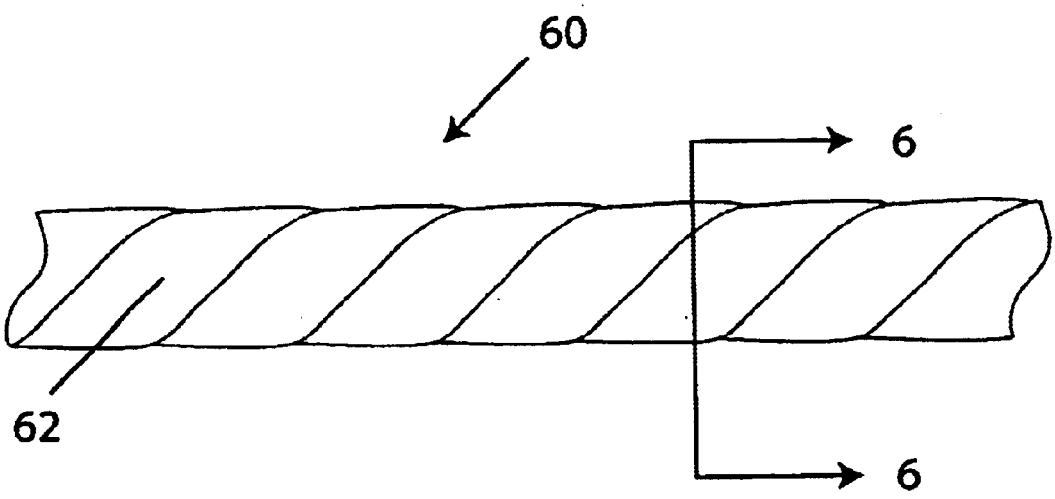
FIG. 5 is a plan view of a twisted filament yarn.
Figure 6:
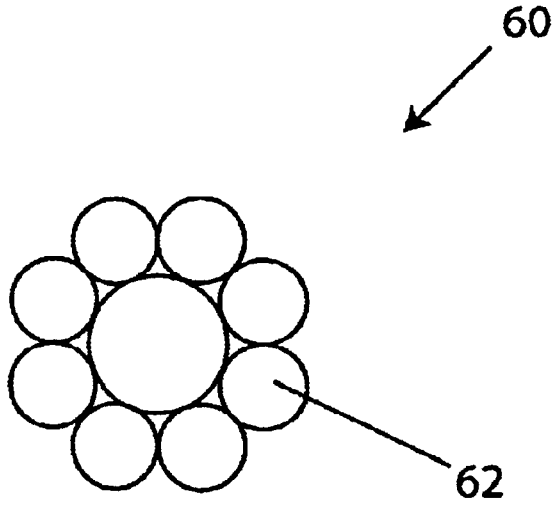
FIG. 6 is a cross-sectional view taken as indicated by line 6—6 in FIG. 5.

Instead of using striated monofilaments to achieve the slippage-inhibiting effect of the present invention, twisted or braided filament yarns, which naturally have rough surfaces compared to monofilaments, may be used in place of striated monofilaments. FIG. 5 is a plan view of a twisted filament yarn 60, and FIG. 6 is a cross-sectional view thereof taken as indicated by line 6—6 in FIG. 5. Twisted filament yarn 60 comprises eight individual filaments 62 twisted about one another, although the twisted filament yarn 60 should not be considered to be limited to the variety shown in FIG. 5.

In either case, the striated monofilaments, or the individual filaments making up a twisted or braided yarn, may be produced by extrusion from any of the polymeric resin materials used by those skilled in the art to make yarns for use in papermaker's and industrial fabrics. These include polyethylene terephthalate (PET); polybutylene terephthalate (PBT); polycyclohexanedimethylene terephthalic acid (PCTA); polyamides, such as PA 6; PA 6, 6; PA 6, 10; PA 6, 12 and copolymers thereof; polyethylene napthalate (PEN); polyphenylene sulfide (PPS); and polyetheretherketone (PEEK). Blends and coated or surface-modified versions of these polymeric resin materials may also be used, especially those having an enhanced ability to dissipate static charge build-up.

For example, the striated monofilaments, or the individual filaments making up a twisted or braided yarn, may be produced as either sheath/core or as surface-coated products, wherein the sheath or surface coating exhibits static-dissipative or conductive electrical properties which provide the striated monofilaments or individual filaments with a resistance per unit length of less than $10^{10}$ ohm/cm. The sheath or surface coating may be manufactured using a variety of standard methods from materials which include metallic, carbon black or intrinsically conductive polymeric materials to provide the striated monofilaments or filaments with improved conductivity properties.

The striated monofilaments may be produced by extrusion through dies having openings of appropriate shape. They may also be produced by coextrusion, in which the monofilament is extruded through a die having an opening of appropriate shape and simultaneously coated with a solvent-removable material, the latter of which may be removed after the industrial fabric has been woven to reveal the striations on the surface of the monofilaments.

The striated monofilaments, or individual filaments making up a braided yarn, may alternatively be of metal wire. Stainless steel, brass, bronze and Invar®, an alloy of iron and nickel, may be used for this purpose.

Modifications to the above would be obvious to those of ordinary skill in the art, but would not bring the invention so modified beyond the scope of the appended claims.

What is claimed is:

1. An industrial fabric in the form of an endless fabric belt to form and convey a nonwoven fiber web during the manufacture of a nonwoven fabric therefrom, said industrial fabric being woven from warp yarns and weft yarns and having a web-supporting surface, at least some of one of said warp and weft yarns on said web-supporting surface of said industrial fabric being rough-surface yarns, said rough-surface yarns having an outer layer comprising a sheath or coating of a conductive material which for dissipating static charge build-up.

2. The fabric as claimed in claim 1 wherein said rough-surface yarns are striated monofilaments having a plurality of substantially lengthwise channels running along the surface thereof.

3. The fabric as claimed in claim 2 wherein said striated monofilaments have a cross-sectional shape, exclusive of said channels, selected from the group consisting of circular, oval, elliptical, square and rectangular shapes.

4. The fabric as claimed in claim 3 wherein said channels in said striated monofilaments having circular cross-sectional shape have a depth in the range from 5% to 25% of the diameter of said striated monofilaments.

5. The fabric as claimed in claim 2 wherein said striated monofilaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6, 6; PA 6, 10; PA 6, 12 and copolymers thereof; polyethylene napthalate (PEN); polyphenylene sulfide (PPS); and polyetheretherketone (PEEK); and blends thereof.

6. The fabric as claimed in claim 2 wherein said striated monofilaments are of metal wire selected from the group consisting of stainless steel, brass, bronze and iron-nickel alloy wire.

7. The fabric as claimed in claim 1 wherein said rough-surface yarns are multistrand yarns comprising a plurality of filaments.

8. The fabric as claimed in claim 7 wherein said plurality of filaments are twisted about one another.

9. The fabric as claimed in claim 7 wherein said plurality of filaments are braided together.

10. The fabric as claimed in claim 7 wherein said filaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6,6;

PA 6,10; PA 6,12 and copolymers thereof; polyethylene napthalate (PEN); polyphenylene sulfide (PPS); and polyetheretherketone (PEEK); and blends thereof.

11. The fabric as claimed in claim 7 wherein said filaments are of metal wire selected from the group consisting of stainless steel, brass, bronze and iron-nickel alloy wire.

12. The fabric as claimed in claim 1 wherein at least some of both of said warp and weft yarns on said web-supporting surface of said industrial fabric are said rough-surface yarns.

13. The fabric as claimed in claim 1 wherein all of one of said warp and weft yarns on said web-supporting surface of said industrial fabric are said rough-surface yarns.

14. The fabric as claimed in claim 1 wherein all of both of said warp and weft yarns on said web-supporting surface of said industrial fabric are said rough-surface yarns.

15. The fabric as claimed in claim 1 wherein at least some of said rough-surface yarns make long floats on said web-supporting surface of said fabric.

16. The fabric as claimed in claim 1 wherein said warp and weft yarns are woven in a single-layer weave.

17. The fabric as claimed in claim 1 wherein said warp and weft yarns are woven in a double-layer weave.

18. The fabric as claimed in claim 1 wherein said warp and weft yarns are woven in a triple-layer weave.

19. The fabric as claimed in claim 1 wherein said rough-surface yarns have an outer layer comprising a sheath or coating of conductive material which provides a resistance per unit length less than 1010 ohms/cm.

20. In an industrial fabric of the variety used in the form of an endless fabric belt to form and convey a nonwoven fiber web during the manufacture of a nonwoven fabric therefrom, said industrial fabric being woven from warp yarns and weft yarns and having a web-supporting surface, the improvement comprising:

at least some of one of said warp and weft yarns on said web-supporting surface of said industrial fabric being rough-surface yarns, wherein said rough-surface yarns are striated monofilaments having a plurality of substantially lengthwise channels running along the surface thereof, wherein said striated monofilaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6, 6; PA 6, 10; PA 6, 12 and copolymers thereof; polyethylene napthalate (PEN); polyphenylene sulfide (PPS); and polyetheretherketone (PEEK); and blends thereof, and wherein said striated monofilaments have an outer layer comprising a sheath or coating of a conductive material for dissipating static charge build-up.

21. In an industrial fabric of the variety used in the form of an endless fabric belt to form and convey a nonwoven fiber web during the manufacture of a nonwoven fabric therefrom, said industrial fabric being woven from warp yarns and weft yarns and having a web-supporting surface, the improvement comprising:

at least some of one of said warp and weft yarns on said web-supporting surface of said industrial fabric being rough-surface yarns, wherein said rough-surface yarns are striated monofilaments having a plurality of substantially lengthwise channels running along the surface thereof, wherein said striated monofilaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6, 6; PA 6, 10; PA 6, 12 and copolymers thereof; polyethylene napthalate (PEN); polyphenylene sulfide (PPS); and polyetheretherketone (PEEK); and blends thereof, and wherein said striated monofilaments have an outer layer comprising a sheath or coating of conductive material which provides a resistance per unit length less than $10^{10}$ ohms/cm.

22. In an industrial fabric of the variety used in the form of an endless fabric belt to form and convey a nonwoven fiber web during the manufacture of a nonwoven fabric therefrom, said industrial fabric being woven from warp yarns and weft yarns and having a web-supporting surface, the improvement comprising:

at least some of one of said warp and weft yarns on said web-supporting surface of said industrial fabric being rough-surface yarns, wherein said rough-surface yarns are striated monofilaments having a plurality of substantially lengthwise channels running along the surface thereof, wherein said striated monofilaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6, 6; PA 6, 10; PA 6, 12 and copolymers thereof; polyethylene napthalate (PEN); polyphenylene sulfide (PPS); and polyetheretherketone (PEEK); and blends thereof, and wherein said striated monofilaments have an outer layer comprising a sheath or coating of a material which provides conductivity properties.

23. The fabric as claimed in claim 22 wherein said material of said outer layer includes a material selected from the group consisting of metallic, carbon black and intrinsically conductive polymeric materials.

24. In an industrial fabric of the variety used in the form of an endless fabric belt to form and convey a nonwoven fiber web during the manufacture of a nonwoven fabric therefrom, said industrial fabric being woven from warp yarns and weft yarns and having a web-supporting surface, the improvement comprising:

at least some of one of said warp and weft yarns on said web-supporting surface of said industrial fabric being rough-surface yarns, wherein said rough-surface yarns are multistrand yarns comprising a plurality of filaments, wherein said filaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6,6; PA 6,10; PA 6,12 and copolymers thereof; polyethylene napthalate (PEN); polyphenylene sulfide (PPS); and polyetheretherketone (PEEK); and blends thereof, and wherein said filaments have an outer layer comprising a sheath or coating of a conductive material for dissipating static charge build-up.

25. In an industrial fabric of the variety used in the form of an endless fabric belt to form and convey a nonwoven fiber web during the manufacture of a nonwoven fabric therefrom, said industrial fabric being woven from warp yarns and weft yarns and having a web-supporting surface, the improvement comprising:

at least some of one of said warp and weft yarns on said web-supporting surface of said industrial fabric being rough-surface yarns, wherein said rough-surface yarns are multistrand yarns comprising a plurality of filaments, wherein said filaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6,6; PA 6,10; PA 6,12 and copolymers thereof; polyethylene napthalate (PEN); polyphenylene sulfide (PPS); and polyetheretherketone (PEEK); and blends thereof, and wherein said filaments have an outer layer comprising a sheath or coating of conductive material which provides a resistance per unit length less than $10^{10}$ ohms/cm.

26. In an industrial fabric of the variety used in the form of an endless fabric belt to form and convey a nonwoven fiber web during the manufacture of a nonwoven fabric therefrom, said industrial fabric being woven from warp yarns and weft yarns and having a web-supporting surface, the improvement comprising:

at least some of one of said warp and weft yarns on said web-supporting surface of said industrial fabric being rough-surface yarns, wherein said rough-surface yarns are multistrand yarns comprising a plurality of filaments, wherein said filaments are extruded from a polymeric resin material selected from the group consisting of polyethylene terephthalate (PET); polybutylene terephthalate (PBT); polycyclohexanedimethylene terephthalic acid (PCTA); polyamides, such as PA 6; PA 6,6; PA 6,10; PA 6,12 and copolymers thereof; polyethylene napthalate (PEN); polyphenylene sulfide (PPS); and polyetheretherketone (PEEK); and blends thereof, and wherein said filaments have an outer layer comprising a sheath or coating of a material which provides conductivity properties.

27. The fabric as claimed in claim 26 wherein said material of said outer layer includes a material selected from the group consisting of metallic, carbon black and intrinsically conductive polymeric materials.

28. A woven industrial fabric comprising striated yarns having an outer layer comprising a sheath or coating of a conductive material which provides a resistance per unit length less than $10^{10}$ ohms/cm for dissipating static charge.

* * * * *